US009201399B2

(12) United States Patent
Cordier et al.

(10) Patent No.: US 9,201,399 B2
(45) Date of Patent: Dec. 1, 2015

(54) TIMEPIECE REGULATING MEMBER

(71) Applicant: Blancpain S.A., Le Brassus (CH)

(72) Inventors: Samuel Cordier, Gex (FR); Edmond Capt, Le Brassus (CH)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 14/423,815

(22) PCT Filed: Sep. 3, 2013

(86) PCT No.: PCT/EP2013/068126

§ 371 (c)(1),
(2) Date: Feb. 25, 2015

(87) PCT Pub. No.: WO2014/033309

PCT Pub. Date: Mar. 6, 2014

(65) Prior Publication Data

US 2015/0212490 A1 Jul. 30, 2015

(30) Foreign Application Priority Data

Sep. 3, 2012 (EP) ..... 12182816

(51) Int. Cl.
*G04B 17/10* (2006.01)
*G04B 18/02* (2006.01)

(52) U.S. Cl.
CPC ..... *G04B 18/02* (2013.01); *G04B 17/10* (2013.01)

(58) Field of Classification Search
CPC ..... G04C 3/04; G04C 3/042; G04C 3/045; G04C 3/047; G04B 17/10; G04B 18/02
See application file for complete search history.

(56) References Cited

U.S. PATENT DOCUMENTS

| | | | | | |
|---|---|---|---|---|---|
| 1,904,169 | A | * | 4/1933 | Reutter | 368/180 |
| 2,860,580 | A | * | 11/1958 | Varaud | 102/276 |
| 3,017,742 | A | * | 1/1962 | Reinhardt | 368/125 |
| 3,454,799 | A | | 7/1969 | Albinger Jr. | |
| 3,497,734 | A | * | 2/1970 | Petrides | 310/36 |
| 3,515,914 | A | * | 6/1970 | Steinemann | 310/37 |
| 3,635,013 | A | * | 1/1972 | Bertsch et al. | 368/169 |
| 3,986,336 | A | * | 10/1976 | Heim | 368/180 |

(Continued)

FOREIGN PATENT DOCUMENTS

| | | |
|---|---|---|
| DE | 251 558 | 10/1912 |
| EP | 2 133 756 | 12/2009 |

(Continued)

OTHER PUBLICATIONS

International Search Report Issued Mar. 7, 2014 in PCT/EP13/068126 Filed Sep. 3, 2013.

*Primary Examiner* — Sean Kayes
(74) *Attorney, Agent, or Firm* — Oblon, McClelland, Maier & Neustadt, L.L.P.

(57) ABSTRACT

A timepiece regulating member including a balance wheel oscillating about an axis subjected to a torque exerted by a torsion return mechanism. The balance includes an attachment mechanism causing it to oscillate integrally with a torsion wire forming the torsion return mechanism specific to the balance, a largest dimension of the cross-section of a useful part of the torsion wire which is subjected to torsion is less than 100 micrometers, a smallest dimension of the cross-section of the useful part is less than 50 micrometers, a total length of the torsion wire is less than 6 millimeters, and the regulating member includes a mechanism tensioning the torsion wire.

23 Claims, 7 Drawing Sheets

(56) References Cited

U.S. PATENT DOCUMENTS

| | | | | |
|---|---|---|---|---|
| 4,308,606 | A * | 12/1981 | Fehrenbacher | 368/180 |
| 4,737,943 | A * | 4/1988 | Kienberger | 368/180 |
| 5,772,803 | A | 6/1998 | Peker et al. | |
| 2009/0303842 | A1 | 12/2009 | Gritti et al. | |
| 2011/0072873 | A1 | 3/2011 | Gritti et al. | |
| 2012/0281510 | A1 | 11/2012 | Gyger et al. | |

FOREIGN PATENT DOCUMENTS

| | | |
|---|---|---|
| EP | 2 154 581 | 2/2010 |
| GB | 616 969 | 1/1949 |
| WO | 2011 069273 | 6/2011 |

* cited by examiner

TIMEPIECE REGULATING MEMBER

FIELD OF THE INVENTION

The invention concerns a watch regulating member, including at least one balance wheel oscillating about an axis of oscillation and subject to a return torque exerted by torsion return means.

The invention also concerns a timepiece movement including at least one such regulating member, oscillating between a main plate and a bridge.

The invention also concerns a timepiece including at least one such timepiece movement.

The invention concerns the field of timepiece regulating mechanisms.

BACKGROUND OF THE INVENTION

The losses of the regulating member directly affect the quality of operation of a watch as well as its power reserve.

The regulating member is conventionally sensitive to the various vertical or horizontal positions of the watch, and differences between the flat/suspended positions are often significant.

Various attempts have been made in the past to omit the balance spring, mostly in static applications such as clocks or fluid counters.

GB Patent Application No 616969A in the name of CLEMEN JORGENSEN discloses a static application of a pendulum clock which is less sensitive to shocks and able to be moved safely. To this end, the return element of the regulating member is formed by a torsion wire anchored at both ends and carrying a balance in the middle thereof, the wire being located vertically. The tension of the wire is achieved via the resilience of its end supports. The useful length of the wire is limited at one of the ends thereof by a position adjustable fork, whose point of contact with the wire determines its useful length. The fork support may be a bimetallic strip to achieve temperature compensation.

Two documents: U.S. Pat. No. 3,635,013 in the name of A BERTSCH HANNS, and DE Patent No 251558C in the name of BRUNO KRAUSZE, also disclose regulators with torsion tubes, or with parallel-mounted torsion wires, or with a single torsion wire.

U.S. Pat. No. 5,772,803 in the name of PEKER ATAKAN discloses a spring made of an amorphous metal alloy, such as a helical spring, torsion beam or torsion tube, not particularly intended for a horological application.

Some documents describe metallic glass springs comprising a curvature: EP Patent Application No 2133756A2 in the name of ROLEX SA discloses a method for shaping a mainspring formed of a one-piece metallic glass ribbon, wherein the theoretical free shape to be given to the one-piece metallic glass ribbon is calculated so that each segment, once the spring is wound inside the barrel, is subjected to the maximum bending moment, the ribbon is shaped by being given curvatures characteristic of this theoretical free shape, to take into account the reduction in curvatures once the ribbon is released, the ribbon is relaxed to set the shape thereof by heating, and then the ribbon is cooled. This ROLEX document focuses on the case of a mainspring whose thickness is greater than 50 micrometers. The other Patent Application WO 2011/069273 A1 in the name of ROLEX SA discloses a method of producing a spring for a timepiece, of similar dimensions, including at least one one-piece metallic glass ribbon comprising at least one curvature, this method including a step of shaping said one-piece ribbon by plastic deformation to obtain at least one portion of said curvature. EP Patent Application No 2154581A1 in the name of ROLEX SA discloses a one-piece metallic glass mainspring with a thickness of more than 40 micrometers.

SUMMARY OF THE INVENTION

The invention endeavours to improve the efficiency of the regulator, by reducing losses, in every position of the watch.

In particular, this means limiting friction, which must not be greater in a horizontal position of the watch than in a vertical position.

And, more specifically, in the case of a high frequency wristwatch, i.e. with an oscillator frequency greater than or equal to 5 Hz.

Thus, the invention proposes to remove the main source of friction formed by the pivots, which may be estimated to be responsible for at least 90% of friction in an oscillator.

The invention also proposes to reduce, as far as possible, the number of components in an oscillator.

To this end, the invention concerns a watch regulating member, comprising at least one balance wheel oscillating about an axis of oscillation and subjected to a return torque exerted by torsion return means, characterized in that said at least one balance includes means of attachment causing the balance to oscillate integrally with a torsion wire which forms said torsion return means specific to said at least one balance, in that the largest dimension of the cross-section of the useful portion of said torsion wire which is subject to torsion is less than 100 micrometers, in that the smallest dimension of the cross-section of said useful portion is less than 50 micrometers, the total length of said torsion wire is less than 6 millimeters, and in that said regulating member comprises means of tensioning said at least one torsion wire.

Utilisation of a suitable torsion wire offers the advantage of fulfilling a dual function:

- generating the return torque of the balance, replacing the conventional balance spring;
- suspending the balance.

According to a feature of the invention, said balance comprises, on both sides of said attachment means along said axis of oscillation, first and second means of limiting the radial clearance between said torsion wire and said balance.

According to a feature of the invention, to avoid any detrimental bending mode, said torsion wire includes at least one intermediate plate of greater cross-section than the useful strands of said torsion wire working in torsion, said intermediate plate being fixed to said at least one balance.

According to a feature of the invention, said torsion wire is made of an at least partially amorphous alloy formed solely of zirconium, titanium, copper, nickel and beryllium, and comprising between 41 and 44% by mass of zirconium, between 11 and 14% by mass of titanium, between 9 and 13% by mass of copper, between 10 and 11% by mass of nickel, between 22 and 25% by mass of beryllium.

The invention also concerns a timepiece movement comprising at least one such regulating member, oscillating between a main plate and a bridge, characterized in that, for embedding said torsion wire, the movement includes means for anchoring said regulating member, formed by first means for anchoring to said bridge and by second means for anchoring to said main plate, and which together define said axis of oscillation of said regulating member.

According to a feature of the invention, said movement includes means of adjusting the tension of said torsion wire by adjusting the distance between said bridge and said main plate.

The invention also concerns a timepiece including at least one such timepiece movement, characterized in that the timepiece is a watch, and in that said regulating member oscillates at a frequency higher than or equal to 5 Hz.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 3:
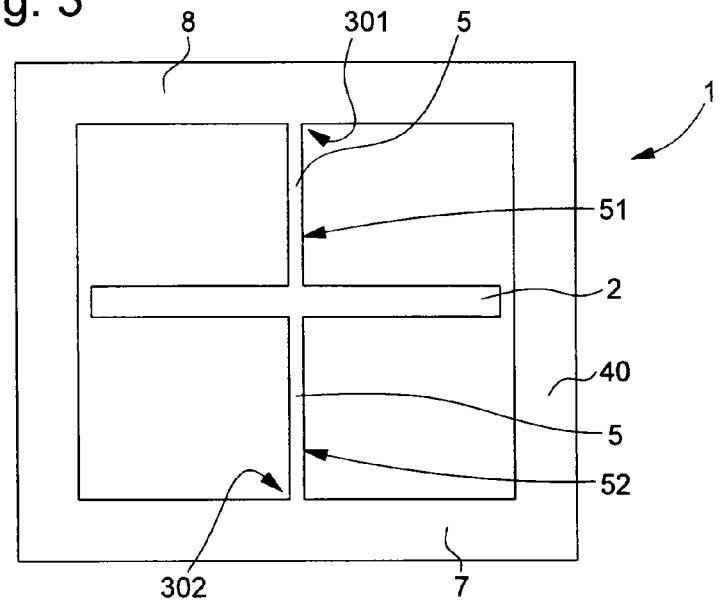
FIG. 3 is a schematic illustration of a one-piece variant of the invention, with a frame structure maintaining the tension of a torsion wire carrying a balance made in the form of a beam.

The invention proposes to improve the performance of the regulating member of a watch.

The problem that the invention proposes to overcome is linked to several observations:

- the losses of a regulating member directly affect the quality of operation of a watch as well as its power reserve. There are three types of losses: dry friction (pivots), linear friction (air on the balance) and quadratic friction;
  - a significant portion of these losses is linked to the existence of pivots;
  - the regulating member is conventionally sensitive to the different vertical or horizontal positions of the watch, and the differences between the flat/suspended positions are often significant.

The invention proposes in particular:

- to improve the efficiency of the regulator, by reducing losses through dry friction, in every position of a watch;
- and, more specifically, in the case of a high frequency wristwatch, i.e. with an oscillator frequency higher than or equal to 5 Hz.

Two approaches can be explored:

- improvement of a conventional oscillator through the use of a metallic glass balance spring; this approach has been the subject of much research, and is not adopted here;
- the use of torsion return means, particularly a torsion wire.

In the prior art, timepiece mechanisms with a torsion wire, generally limited to pendulums, fluid counters, and artillery rockets!, a torsion wire is arranged in the direction of the highest accelerations present, particularly the force of gravity in the case of a pendulum. This axial arrangement of the wire relative to the local vertical is a constant feature of timepieces intended for the display of time. Known mechanisms are not suitable for the case of a watch, which may take any orientation in space and relative to the motions of the user.

To adapt a torsion wire regulating mechanism to a watch, these different problems must therefore all be overcome: losses affecting the quality of operation, sensitivity to different positions, improvement of efficiency.

In the prior art, torsion wire pendulums use metallic torsion wires, which are sufficient for the applications concerned, and there is no suggestion regarding the use of other materials.

However, the miniaturisation imposed by the specific application to watch regulating members does not allow for the use of metallic flat parts or wires, since the available length is incompatible with exertion of sufficient return torque. A torsion wire therefore needs to be developed with one or more useful portions (subjected to torsion to exert an elastic return torque) of very short lengths, compatible with the thickness of a watch movement. The total length LT of the torsion wire to be used is several millimeters, preferably less than 6 millimeters, and less than 5 millimeters in the example embodiment described here, and the useful length LL of the torsion wire is even shorter, this useful length LL may result from the accumulation of several primary useful lengths of sections of the torsion wire, as will be seen below. The useful length of each section working in torsion is then necessarily greatly reduced, typically between approximately 2 and 4 millimeters, and the cross-sections will be on the order of a few micrometers, typically between 20 and 40 micrometers.

The problem of the invention consists, not only in defining a material suitable for producing such a torsion wire, but also in developing a shape which can be achieved using reliable and reproducible industrial manufacturing methods, which is particularly difficult in the field of micro-technology, and with materials not specifically devised for horology.

Only long experimentation, in the face of preconceived notions, permits modulus of elasticity and elastic limit thresholds to be defined, and development of a micrometric torsion wire;

whose material has a modulus of elasticity of more than 100 GPa, and an elastic limit of more than 2000 MPa.

Although new materials derived from "MEMS" and "LIGA" technologies and amorphous materials have heretofore been tested for improving components in conventional balance spring architectures, they have not been tested in architectures less widely used in horology, such as the present case.

The invention therefore concerns a timepiece regulating member 1, comprising at least one balance 2, said balance 2 oscillates about an axis of oscillation D and is subjected to a return torque exerted by torsion return means 4 alternately in the two directions of oscillation.

Preferably, this regulating member 1 is devised for a watch, particularly a wristwatch, which imposes specific constraints as regards compactness and resistance to accelerations.

This balance 2 may, in a non-limiting manner, be made in different shapes: a disc, annular, provided with inertia blocks, or reduced to a simple beam.

The invention proposes to remove the pivots, responsible for at least 90% of the friction in an oscillator. The friction torque of a pivot is proportional to the radius of the pivot. A large radius causes large vertical losses. Thus, where a conventional pivot is used, it is necessary to reduce the radius below a very small value, close to 0.050 mm.

According to the invention, this at least one balance 2 comprises attachment means 10 causing the balance to oscillate integrally with at least one torsion wire 5. This torsion wire 5 forms said torsion return means 4 specific to this at least one balance 2. The use of such a torsion wire 5 makes a balance staff redundant, and therefore removes the need for pivots.

The present description only sets out example embodiments comprising a single torsion wire 5. Naturally, it is possible, without departing from the invention, to combine several torsion wires, either in series with each other, and/or parallel to each other.

Likewise, the example embodiments illustrated comprise only one balance. In the case where several balances are juxtaposed, they may be connected rigidly, or by an intermediate section of the same torsion wire, this intermediate section may or may not be used in torsion.

This torsion wire 5 preferably has a modulus of elasticity of more than 100 GPa, and preferably more than 120 GPa, and an elastic limit of more than 2000 MPa. These specific characteristics of the torsion wire (modulus of elasticity of more than 100 GPa, and elastic limit of more than 2000 MPa) are the result of long, complex experimentation, due to development difficulties and the very small micrometric dimensions of torsion wire 5, and they form a specific characteristic of a wire used in a specific regulating member. "Micrometric dimensions" means here the dimensions of a wire wherein the largest dimension of the cross-section of the useful part (as the part of wire subjected to torsion will be referred to hereafter) is several micrometers or several tens of micrometers, and in any event less than 100 micrometers, and wherein the smallest dimension of the cross-section of the useful part is several micrometers or several tens of micrometers, and in any event less than 50 micrometers.

The utilisation of such a torsion wire is a good alternative to the usual pivot, its dimensions may be much reduced, in particular the largest dimension of the cross-section of the useful part is preferably less than 0.040 mm, namely a radius value of less than 0.020 mm.

The choice of a high modulus of elasticity ensures good rigidity of the torsion wire, and determines the quality of its suspended support of the balance. Moreover, the geometry of such a torsion wire ensure the axiality of the balance. Proper tensioning of the torsion wire ensures equality of tension on both sides of the balance.

Choosing high modulus of elasticity and elastic limit ranges inevitably restricts the choice of materials that can be used.

The utilisation of a metallic glass is entirely appropriate here; it also makes it possible to obtain a sufficient angular amplitude for the balance, namely approximately 100°, divided approximately into: 50° for cooperation with the escape wheel, and 50° for the entries/exits of the maintenance system.

It is also possible to employ a torsion wire 5 with lower characteristics than the preferred characteristics cited above. In any event, the modulus of elasticity must be greater than 60 GPa, and the elastic limit greater than 1000 MPa.

The ratio between the modulus of elasticity and the upper elastic limit is advantageously comprised between 40 and 80, and preferably close to 60.

The ratio between the free length LL of torsion wire 5, i.e. the length over which it is unhindered and can twist and vibrate freely, and the largest dimension LG of the cross-section of its useful part is advantageously comprised between 80 and 150 and preferably close to 115.

For good operating efficiency of torsion wire 5, regulating member includes means 400 for tensioning torsion wire 5. In preferred embodiments, such as those set out below, regulating member 1 also includes tension adjustment means 20 for the tension of torsion wire 5 which are arranged to act on tensioning means 400.

Figure 2:
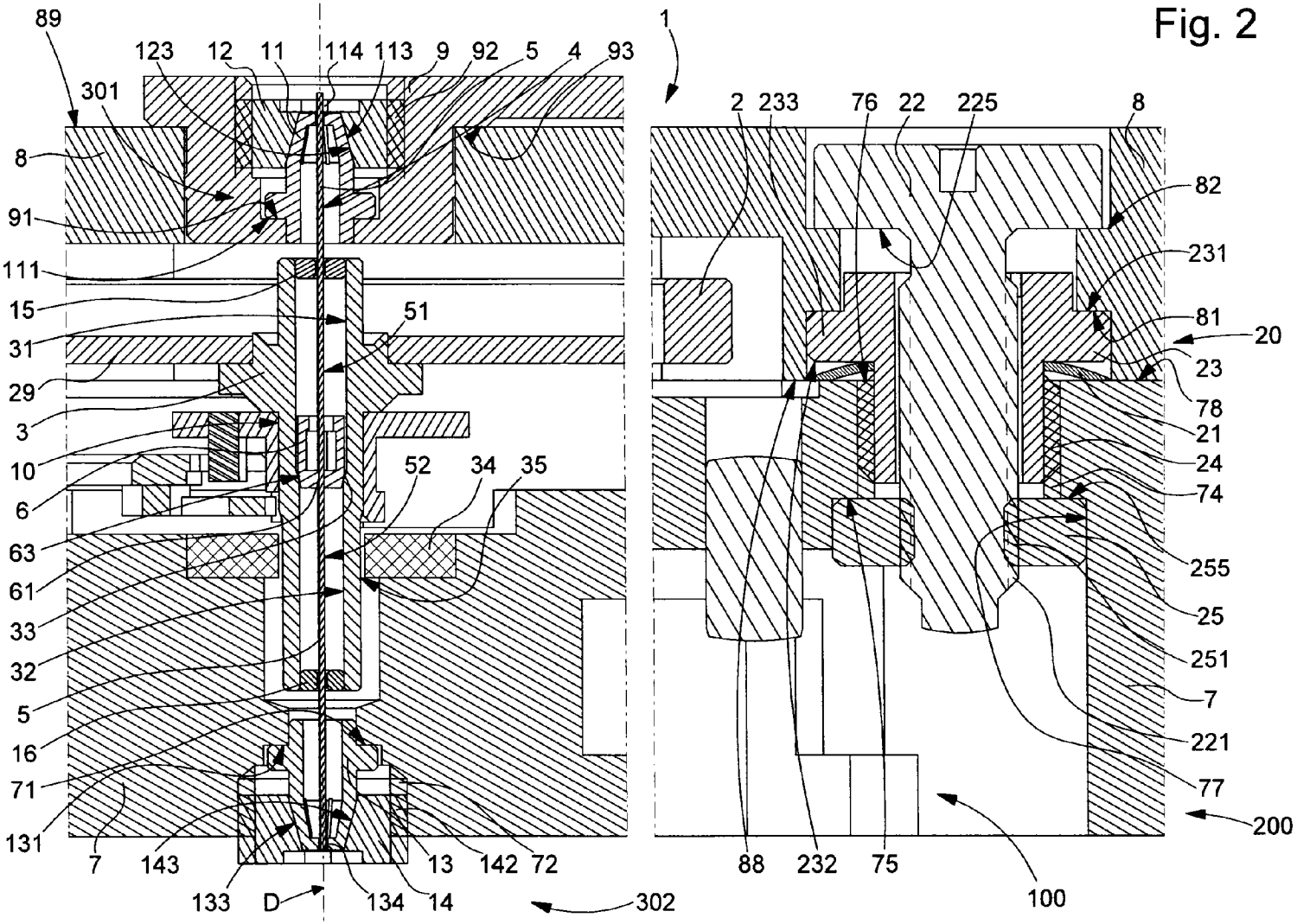
FIG. 2 shows a similar, schematic view to FIG. 1 of a detail of a timepiece, showing a movement comprising a regulating member according to a first embodiment of the invention.

In a specific, non-limiting mode, shown in FIG. 2, of a first embodiment of the invention, balance 2 comprises a rim 29 forming an inertia block, which oscillates integrally with a balance staff 3. This staff 3 is tubular, so as to allow torsion wire 5 to pass through, and includes a first bore 31 and a second bore 32, separated by an area of reduced cross-section, for example a shoulder 33, as seen in FIG. 2. In an economical variant embodiment, the first bore 31 and second bore 32 have different diameters and shoulder 33 is formed simply by the surface which joins one bore to the other. Means of attachment 10 may consist, in a non-limiting manner, of a connecting element 6 fixed to torsion wire 5 by crimping, clamping, driving in, bonding, brazing, welding or another suitable method ensuring sufficient hold to resist the maximum operating torque and high accelerations, typically on the order of 5000 g, occurring during any shocks to the timepiece receiving regulating member 1. For example, connection element 6 includes a passage 61 for torsion wire 5, in which the wire is immobilised, and further includes a support 63 arranged to cooperate in abutment on shoulder 33.

In another variant, connection element 6 is not pre-crimped on torsion wire 5, it is only crimped after wire 5 has been inserted into the bore in staff 3 and suitably positioned.

To limit the relative clearance between balance 2 and the torsion wire 5 associated therewith, in particular during lateral bending of torsion wire 5, balance 2 advantageously comprises, on both sides of attachment means 10 along axis of oscillation D, first 15 and second 16 means of limiting the radial clearance between torsion wire 5 and balance 2.

In a variant that is not illustrated, clearance limiting means may be fitted to a movement 100, on a plate 7 and a bridge 8 between which balance 2 oscillates, in place of or in addition to the first 15 and second 16 means of limiting the radial clearance between torsion wire 5 and balance 2.

In this same example of the first embodiment of FIG. 2, first 15 and second 16 clearance limiting means are formed by jewels comprising a passage corresponding to the diameter of the largest radial dimension of torsion wire 5. Thus, in an advantageous case, where, at least in its useful part, torsion wire 5 has a rectangular cross-section (or square cross-section which is a specific case of the rectangular cross-section), these jewels each include a bore whose diameter is very slightly larger than the diagonal of the torsion wire cross-section, having a value that is preferably comprised within a range at the diagonal of the cross-section of the torsion wire, and in a specific embodiment, greater than or equal to 10 micrometers.

To obtain a high modulus of elasticity (especially transverse) and thereby allow improved efficiency of the regulator, it is necessary to choose a material which, for a given torsion torque, enables a larger elastic deformation amplitude to be obtained than that which could be obtained with a conventional wire made of crystalline material, and, consequently, which makes it possible to increase the amplitude of balance 2 and the quality factor of regulator 1.

Thus, in a first variant, torsion wire 5 is made of metallic glass, or of an at least partially amorphous alloy formed only of zirconium, titanium, copper, nickel and beryllium, and comprising between 41 and 44% by mass of zirconium, between 11 and 14% by mass of titanium, between 9 and 13% by mass of copper, between 10 and 11% by mass of nickel, and between 22 and 25% by mass of beryllium.

In a specific application of this first variant, torsion wire 5 is made of "LM1b" produced by "Liquidmetal", a material which has a Young's modulus of 98 GPa and an elastic limit of 1700 MPa. This metallic glass has the advantage of combining high modulus of elasticity and elastic limit values.

In another specific application of this first variant, torsion wire 5 is made of the metallic glass "LM10" produced by "Liquidmetal" ©.

In a second variant, torsion wire 5 is made of metallic glass, or an at least partially amorphous alloy comprising by mass 75.44% of nickel, 13% chromium, 4.2% iron, 4.5% silicon, 0.06% carbon, and 2.8% boron.

In a specific application of this second variant, torsion wire 5 is made of the metallic glass referenced "MBF20" produced by "Metglas®". The Young's modulus of "MBF20" is close to 140 GPa and its elastic limit is approximately 2500 MPa.

In these first and second variants, a torsion wire 5 with a total useful length LL of 4.2 mm, and a cross-section of the useful part of 37×20 micrometers gives good isochronism results for a 5 Hz oscillator with a balance having inertia of 12 mg·cm2.

In yet another variant, torsion wire 5 is made of silicon and/or silicon oxide.

In yet another variant, torsion wire 5 is made of single crystal diamond or polycrystalline diamond.

Figure 4:
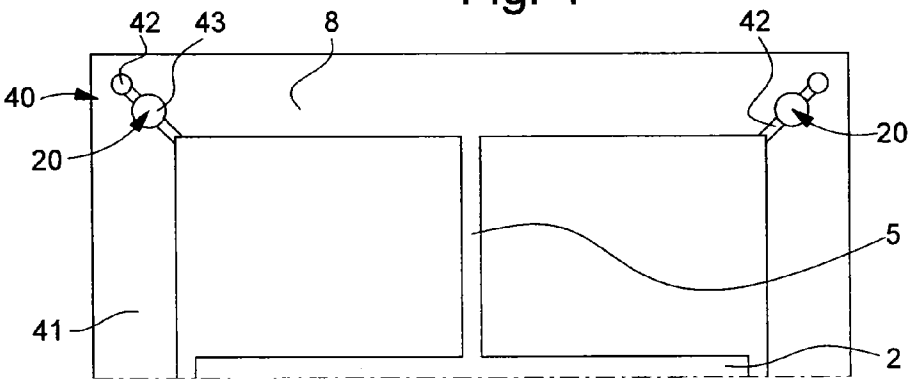
FIG. 4 is a variant of FIG. 3 comprising means of adjusting the tension of the torsion wire.
Figure 1:
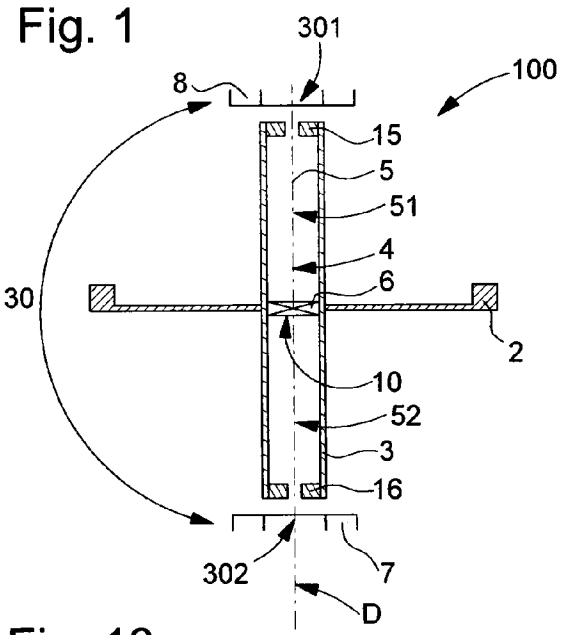
FIG. 1 shows a schematic cross-sectional view, in a plane through the axis of oscillation of the balance, of a regulating member with a torsion wire according to the invention.
Figure 13:
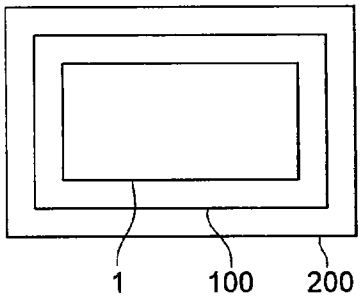
FIG. 13 shows a block diagram of a watch including a movement comprising a movement which in turn comprises a regulating member according to the invention.

Embodiments with a torsion wire made of micromachinable material also permit, as seen in FIG. 3, a one-piece silicon or similar frame to be made, with tension adjustment on an anchor of torsion wire 5. The complete structure 40 can be made, preferably in one-piece, of silicon or similar. This structure 40 includes a rigid frame 41, in which torsion wire 5 is stretched, balance 2 is made in the form of a beam here. FIG. 4 shows a variant comprising tension adjustment means 20 for torsion wire 5 made, for example, in the form of a cam 43 or a wedge inserted in a slot 42 or similar.

Movement 100 may comprise a plurality of tension adjustment means 20, particularly two, arranged substantially symmetrically relative to axis of oscillation D, so as to displace bridge 8 parallel to plate 7; otherwise, a column guide can be used to ensure parallelism with a single tension adjustment screw 22.

In a specific embodiment of the invention, at least in its useful part, torsion wire 5 has a rectangular or square cross-section. A square cross-section, more specifically, ensures the same behaviour of the regulating member in every position of the timepiece in which it is incorporated. For example, the useful, active part of torsion wire 5 may have a square cross-section with 30 micrometer sides made of metallic glass, or 27 micrometer sides made of silicon.

Naturally, if the choice of the cross-section shape is dictated by production constraints (shaping the above selected materials being particularly difficult in these small dimensions), and by achieving high performance levels, other profiles may be implemented: a triangle, hexagon, polygon, circle, ellipsis, or other shape. However, the difficulty of producing a micrometric torsion wire, as defined above, is such that reliable and repetitive production of the torsion wire is a problem in itself, and choosing cross-section profiles that are difficult to produce only makes the problem of repetitive production more difficult to overcome.

Preferably, the material of torsion wire 5 is chosen such that torsion wire 5 has a modulus of elasticity (particularly transverse) in a direction perpendicular to axis of oscillation D, greater than 100 GPa, and preferably greater than 120 GPa. This condition is achieved with an embodiment made of an aforecited at least partially amorphous alloy, or made of the "Liquidmetal©" metallic glass referenced "LM1b", or of the "Metglas®" metallic glass referenced "MBF20".

Regulating member 1 preferably includes, for embedding torsion wire 5 and for forming means 400 for tensioning torsion wire 5, means 30 of anchoring regulating member 1. These anchoring means 30 include: at a first end of torsion wire 5 first anchoring means 301 and/or, at a second end of torsion wire 5 opposite to the first, second anchoring means 302. These first anchoring means 301 and second anchoring means 302 define together axis of oscillation D of regulating member 1.

The invention also concerns a timepiece movement 100 comprising at least one such regulating member 1, oscillating between a plate 7 and a bridge 8.

Preferably, this movement 100 comprises, for embedding torsion wire 5, and for forming means 400 for tensioning torsion wire 5, means 30 for anchoring regulating member 1. First anchoring means 301 are fixed to bridge 8 and second anchoring means 302 are fixed to plate 7.

In a non-limiting example of the first embodiment of FIG. 2, the first means 301 for anchoring torsion wire 5 to bridge 8 include a first clamp 11, particularly a slit clamp comprising a slot 114 for the passage of torsion wire 5. This first clamp 11 includes a bearing surface 111 facing balance 2 and which is arranged to bear on a complementary bearing surface 91 comprised in bridge 8 or, as shown in FIG. 2, an orientable support 9 placed on bridge 8.

This orientable support 9 is preferably, but not restrictively, driven onto bridge 8 with sufficient friction to hold it in position. It can be oriented in the manner of a stud-holder, which permits fine adjustment of the alignment of guide-marks on the impulse pin, the fork and the escapement line. This orientable support may, also, be held in its angularly adjusted position by holding means, not shown in the Figure. FIG. 2 shows orientable support 9 provided with a shoulder 93 cooperating in abutment with an upper surface 89 of bridge 8. Naturally, it is possible, in a variant embodiment, to give support 9 a longitudinal travel along axis D, so as to form, at the same time, tension adjustment means 20, in an embodiment with a cannon-pinion for example. The first clamp 11 further includes a male cone 113 which cooperates with a female cone 123, open towards balance 2 and comprised in a first bush 12. This first bush 12 includes an external thread 122, which cooperates with an internal thread 92 of orientable support 9. When the first bush 12 is screwed in, first clamp 11 clamps torsion wire 5 and immobilises the end of the wire, at the same time that bearing surface 111 of first clamp 11 is bearing on complementary bearing surface 91.

In a similar, substantially symmetrical manner, the second means 302 for anchoring torsion wire 5 to plate 7 comprise a second clamp 13, particularly a slit clamp comprising a slot 134 for the passage of torsion wire 5. This second clamp 13 includes a bearing surface 131 facing balance 2, and which is arranged to bear on a complementary bearing surface 71 comprised, on this side, directly in plate 7. The second clamp 13 also includes a male cone 133 which cooperates with a female cone 143 open towards balance 2 and comprised in a second bush 14. This second bush 14 includes an external thread 142 which cooperates with an internal thread 72 of plate 7. When the second bush 14 is screwed in, the second clamp 13 clamps torsion wire 5 and immobilises the end of the wire, at the same time that bearing surface 131 of second clamp 13 bears on the complementary bearing surface 71.

In another variant, at one end of wire 5, material is melted around wire 5 so as to form a bump, which is stopped when the opposite end of the wire is pulled, in a conical well or spherical dish or suchlike, blocking the bump.

In yet another variant, the anchoring of torsion wire 5 is achieved by crimping.

These variants for anchoring the torsion wire are not limiting.

Thus, torsion wire 5, provided with attachment means 10 fixed in position, is inserted into staff 3 of balance 2, which is provided with a rim 29, rollers and impulse pins. Wire 5 is pulled and stopped between bearing surface 63 and shoulder 33. A second end of torsion wire 5, on the side of plate 7, is inserted into second clamp 13 and pre-clamped in position, by means of second bush 14. A first end of wire 5, on the side of bridge 8, is inserted into first clamp 11 and pre-clamped in position, by means of second bush 12. Action on first bush 12 and second bush 14 permits adjustment of the clearance, on the plate 7 side, of balance 2 relative to plate 7 and to the components carried thereby, and thereby ensures pre-traction of wire 5.

In a specific variant, as seen in FIG. 2, regulating member 1 also includes shock-resistant means 34 limiting the radial travel of staff 3. These shock-resistant means 34 form an "incabloc" type safety system and may be multiple, disposed on different levels of staff 3 in direction D, and be made in the form of a jewel, or means of magnetic and/or electrostatic repulsion of an opposing surface 35 comprised in staff 3. Such means 34 can advantageously be located on first 15 and second 16 clearance limiting means of torsion wire 5.

Tensioning torsion wire 5 and adjusting the clearance of balance 2 relative to bridge 8 and to the components contained therein, is advantageously achieved by means of an additional device: timepiece movement 100 thus includes means of adjusting the tension 20 of torsion wire 5 by adjustment of the distance between bridge 8 and another component, either plate 7, or a bent strip (particularly at least one of anchors 301 or 302) to perform this adjustment, or similar.

In a variant that is not illustrated, the tension adjustment is performed by means of at least one spring.

As seen in FIG. 2, in a non-limiting example embodiment, these tension adjustment means 20 include a threaded bush 23 which cooperates in a complementary manner with an internal thread 74 of plate 7. At least one screw 22 cooperating with a nut 5 integral with plate 7 is arranged to push bridge 8 towards plate 7, bearing on bush 23 in its adjustment position. This screw 22 cooperates, via an external thread 221 comprised therein, with an internal thread 251 of a nut 25 which is driven into a housing 77 of plate 7, or which is an integral part thereof. This screw 22 is concentric to a threaded bush 23, whose external thread 24 cooperates in a complementary manner with an internal thread 74 of plate 7. Bush 23 tends to move away from plate 7 under the action of an elastic return means 21, such as a conical spring, Belleville spring, Schnorr washer, or suchlike, bearing both on a bearing surface 76 of plate 7 and on a bearing surface 232 of bush 23 which has a collar 233 arranged to exert a thrust force on a bearing surface 1 of bridge 8. After a height adjustment of bush 23, with bridge 8 removed by the operator performing the adjustment of torsion wire 5, the operator sets the bridge in position and inserts screw 22. When screw 22 is screwed into nut 5, a lower surface 225 of the head of screw 22 bears on an upper bearing surface 82 of bridge 8, a lower bearing surface 81 of bridge 8 cooperates in abutment with an upper bearing surface 231 of bush 23. The position of bridge 8 determines the tension of wire 5. The adjustment limit is provided by an upper surface 78 of plate 7 and a lower surface 88 of bridge 8.

Preferably, the tension in the torsion wire is greater than 0.1 N; in fact the tension must be ensured with less than 5 micrometers displacement in vertical direction.

Preferably, adjustments are performed such that the maximum tolerable bending in the vertical position is less than or equal to 5 micrometers.

Torsion return means 4 operate in torsion, but are also subjected to bending, under the effect of torque imparted by the balance, or by the movement and transmitted by the balance. It is preferable to minimise bending deformations, and to ensure that the torsion return means 4, especially when formed by a torsion wire 5, do not have a vibration antinode at the point of attachment to balance 2. Thus, to avoid any detrimental bending mode, torsion wire 5 includes, in an advantageous embodiment seen in FIGS. 5, 7, 8, 10 and 11, at least one intermediate plate 53. The cross-section of this intermediate plate 53 is greater than the useful strands 51, 52 of torsion wire 5 operating in torsion, described below. This intermediate plate 53 is located at the attachment to balance 2, preferably in the median portion of torsion wire 5, or to each balance 2 if there are several. The value is thus moved away from natural bending modes (natural frequency on the order of 600 Hz to be compared to the 5 to 10 Hz of the oscillator). This intermediate plate 53 also strengthens the attachment of balance 2.

Figure 5:
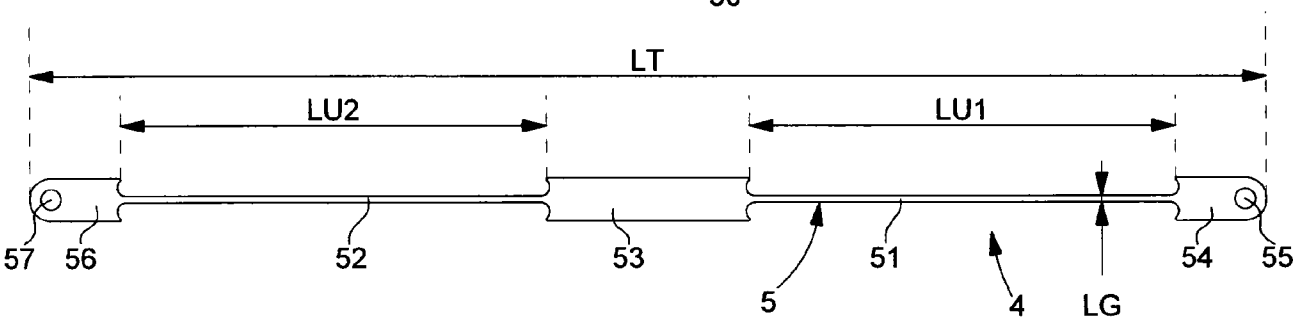
FIG. 5 is a plan view of a specific variant of the torsion wire, which includes an intermediate plate, and which is made from a blank shown in FIG. 6.

FIG. 5 illustrates such a torsion wire 5 in an advantageous embodiment where the torsion wire includes such an intermediate plate 53 between two strands 51 and 52. These strands 51 and 52 each form a free torsional portion. Preferably, torsion wire 5 includes, at the ends of these strands 51 and 52 opposite intermediate plate 53, end plates 54 and 56, particularly provided with bores or holes 55 and 57, for anchoring torsion wire 5 and maintaining the tension thereof. It is clear that the useful part of torsion wire 5 is then formed by strand 51 and strand 52. Intermediate plate 53 and end plates 54 and 56 are intended to be embedded in the holding clamps, or to be attached by any other means (welding, bonding or other means) to the elements for attachment to the various components of the regulating member 1 concerned. The total useful length LL is here the sum of the useful lengths LU1 and LU2 of strands 51 and 52.

Figure 6:
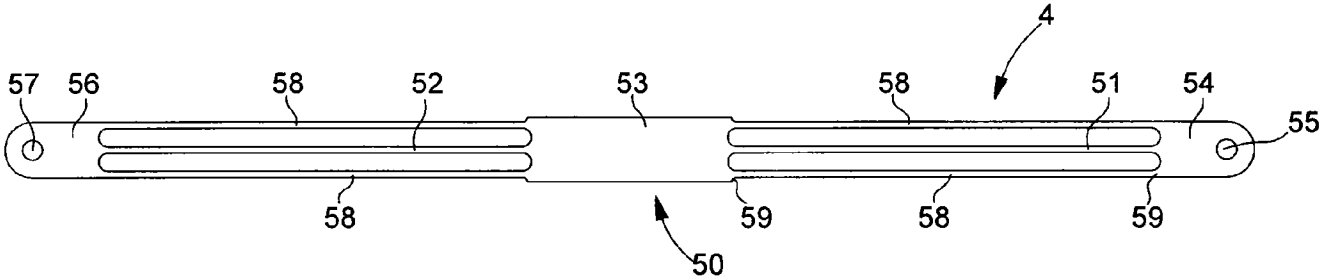
FIG. 6 shows a plan view of the blank.

The major difficulties of implementing the invention consist in the production of micrometric torsion wire 5, which is extremely difficult using the aforecited materials, particularly metallic glass which gives very good functional results, and assembling the wire in regulating member 1 without damaging it. A good solution is seen in FIG. 6 and lies in the use of a blank 50 formed more rigidly than the finished torsion wire 5, so as to allow for manipulation by an operator or by an automated operator, and the insertion thereof in the oscillator. This blank includes breakable stiffeners 58 possibly delimited by brittle areas 59. These breakable stiffeners 58 are broken after assembly and removed from the mechanism. In the specific and non-limiting variant illustrated by FIG. 6, these stiffeners 58 are parallel to strands 51 and 52 of torsion wire 5, on both sides thereof.

Figure 7:
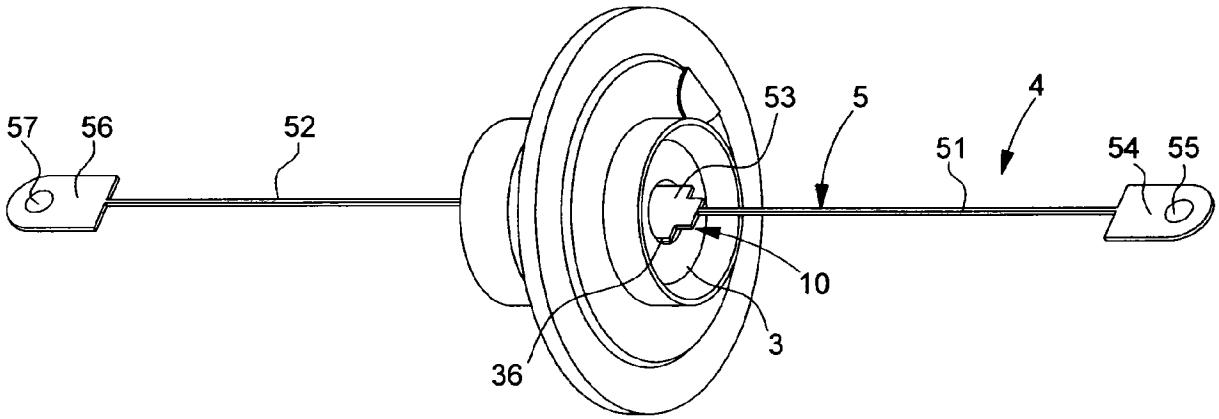
FIG. 7 shows a schematic, perspective view of a balance staff mounted on the intermediate plate of the torsion wire of FIG. 5.
Figure 9A:
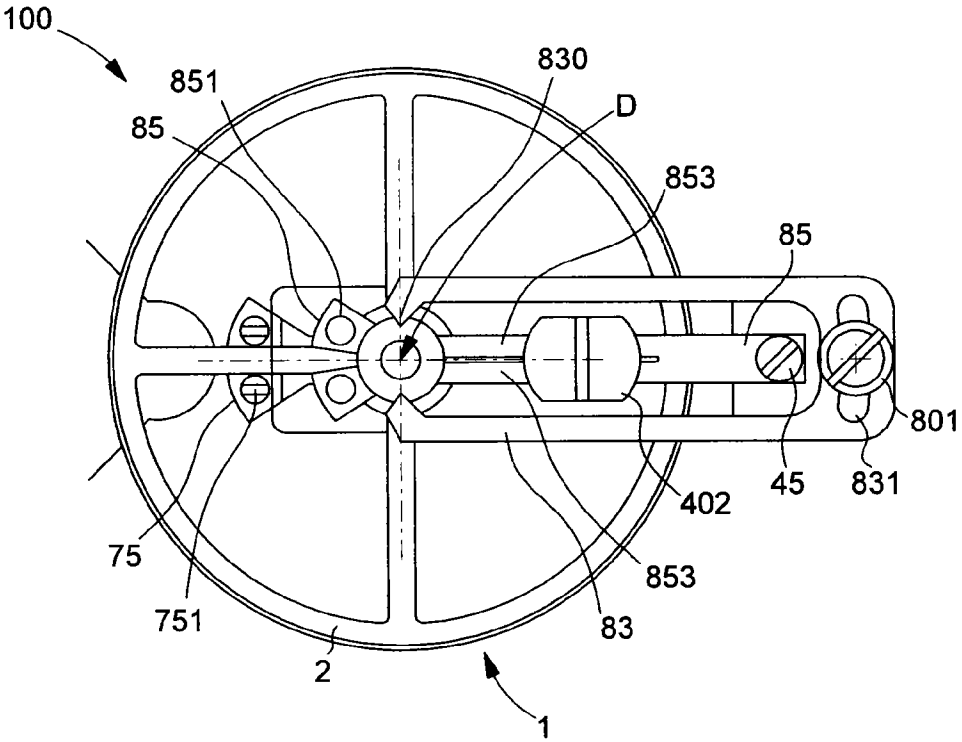
FIG. 9A is a similar, partial view, with no representation of the concealed portions.
Figure 7A:
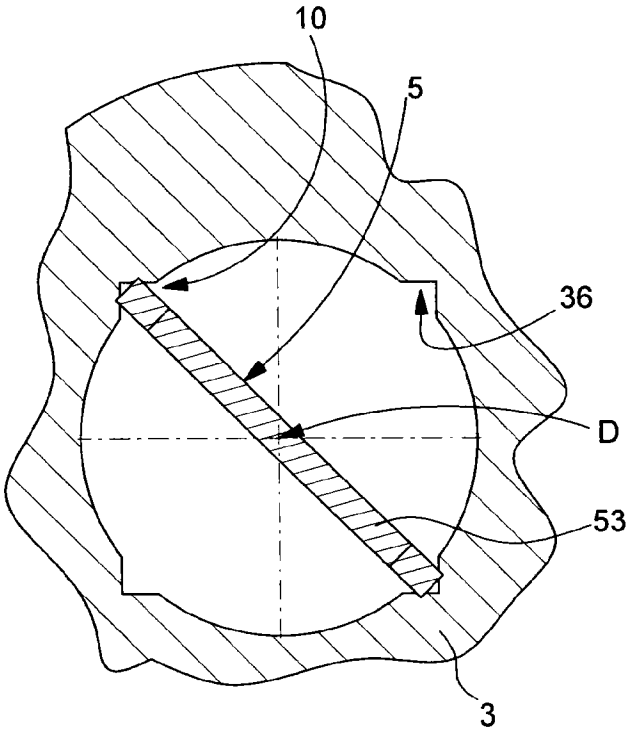
FIG. 7A is a cross-section along a plane perpendicular to the axis of oscillation, passing through the intermediate plate and through a balance staff.

FIG. 7 shows a balance staff 3 mounted on intermediate plate 53 of torsion wire 5 of FIG. 5. Staff 3 may advantageously be in several concentric parts: a central part comprising at least one housing 36 for receiving intermediate plate 53, this central part may comprise a pin housing for the axial positioning of the balance relative to the wire, if intermediate part 53 also includes a housing for such a pin; this central part may be formed as a clamp, by means of at least one elastic slot, and be enclosed by a bush forming a peripheral part of staff 3 and immobilising the clamp by clamping, and thus immobilising intermediate part 53 of torsion wire 5. Housing 36 may take the form of a groove with parallel surfaces, or, as seen in FIGS. 7 and 7A, of a locating with a square female profile, or similar, and preferably housing 36 includes at least one slot or similar, not shown in the Figures, conferring thereon elasticity enabling torsion wire 5 to be held without being damaged.

In a variant, intermediate plate 53 is driven into a housing of square or rectangular cross-section in staff 3, and held by bonding or similar.

FIGS. 8 to 12 illustrate a second embodiment, which is simple to produce and allows for modular pre-assembly. This second embodiment incorporates the features of the torsion wire set out above. Regulating member 1 according to this second embodiment includes at least one adjustment lever 75, 85 for tension adjustment of at least one of the end anchors 301, 302 of torsion wire 5 forming tension adjustment means 20.

Figure 8:
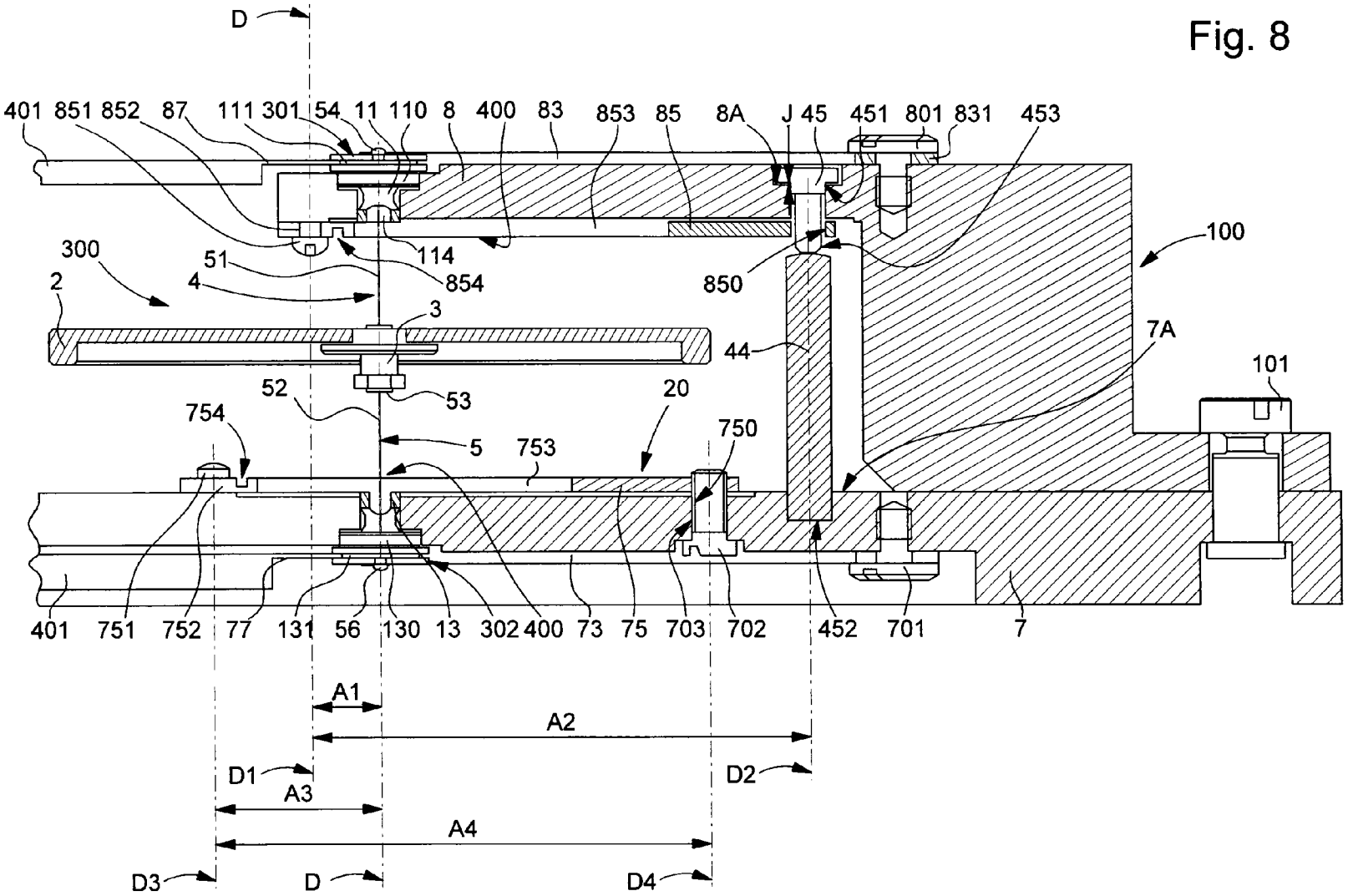
FIG. 8 shows, in a similar manner to FIG. 2, a detail of a movement comprising a regulating member according to a second embodiment of the invention; this regulating member is shown with one part of a removable tool for introducing an equipped module comprising the torsion wire carrying a balance in its middle portion, and anchoring means at its two ends.

FIG. 8 shows first anchoring means 301 intended to clamp an end plate 54 of torsion wire 5 of FIG. 5, and tension adjustment means. The first anchoring means 301 include a clamp 11 clamped by a bush 110. FIG. 10 shows this clamp 11 in which are shown, in dotted lines, an end plate 54 comprised in a torsion wire 5 according to FIG. 5 inserted in a first slot 115 parallel to the axis, and a pin 117 passing through a bore 55 in said end plate 54 and mounted in abutment on a V 116 at the opening of a second slot 113 parallel to axis D and orthogonal to first slot 115. Clamp 11 includes an axial passage 114 for torsion wire 5 to pass through. The first anchoring means 301 also include a bush 110 concentric to clamp 11, visible in FIGS. 8 and 11 and gripping clamp 11. This bush 110 comprises angular indexing notches 112 which cooperate with beaks 830 of an orientation and holding strip 83 seen in FIGS. 8, 9 and 11, and fixed to bridge 8 by a screw 801.

Likewise, the second anchoring means 302 include a clamp 13 enclosed in a bush 130, angularly held by the beaks 730 of a strip 73 fixed to plate 7 by a screw 701.

FIG. 8 shows tension adjustment means 20 for the tension of torsion wire 5 of this second embodiment. These means 20 include at least one adjustment lever 85 on the bridge side, and/or an adjustment lever 75 on the plate side, acting in each case in abutment on the respective bush 11, 13, to modify the position thereof.

Figure 12:
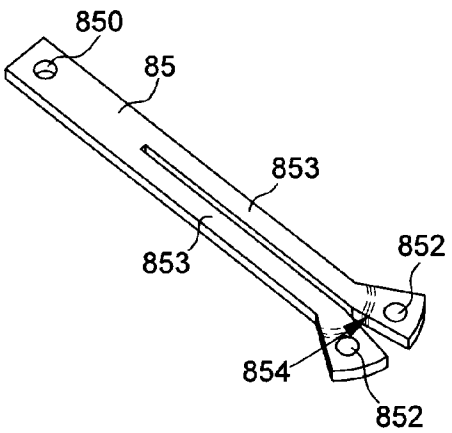
FIG. 12 shows a schematic, perspective view of an adjustment lever, also shown in FIG. 8, enabling a micrometric travel to be applied to the clamp of FIG. 10 by reducing a motion imparted by a screw at one end of the adjustment lever; the adjustment lever includes, in immediate proximity to a fixed point of attachment on a bridge, an area of reduced cross-section giving the adjustment lever sufficient elasticity.
Figure 11:
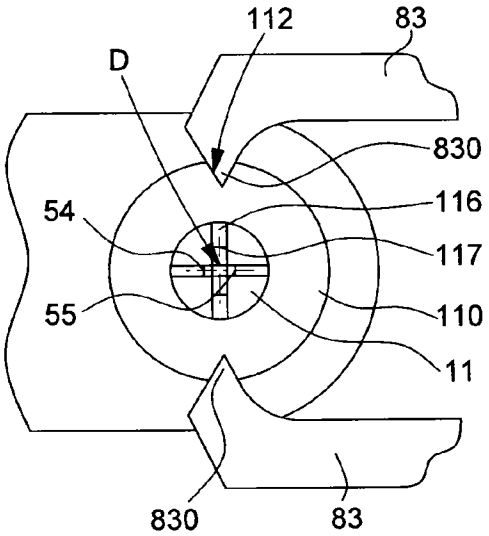
FIG. 11 shows a schematic view similar to FIG. 9 of a detail of the torsion wire anchoring means, which comprise the clamp of FIG. 10, held clamped in a concentric bush, this bush comprising angular indexing notches which cooperate with beaks of an orientation and holding strip.

FIG. 12 illustrates such an adjustment lever 85, which can apply a micrometric travel to clamp 11 by reducing a motion imparted by a screw 45, passing through bridge 8, in an internal thread 850 comprised in adjustment lever 85, along an axis D2 at one end of adjustment lever 85. End 453 of screw 45 abuts on a small connecting rod 44 fixed to plate 7. This adjustment lever 85 includes, in immediate proximity to fixed points of attachment by screws 851 passing through bores 852 along axes D1 and in mesh with bridge 8, at least one area of reduced cross-section 854, such as a groove, conferring sufficient elasticity on said adjustment lever 85. Under the action of the adjustment screw in internal thread 850, an arm 853, or two arms 853 according to the configuration illustrated here, presses on bush 11 and allows fine adjustment of the tension of torsion wire 5.

A similar mechanism exists on the plate 7 side, with an adjustment lever 75 comprising an internal thread 750 along an axis D4 cooperating with a screw 702 passing through plate 7. Adjustment lever 75 includes, in immediate proximity to fixed attachment points by screws 751 passing through bores 752 along axes D3 and in mesh with plate 7, at least one area of reduced cross-section 754.

The reduction ratio of lever 85 on the bridge side is equal to A2/A1, A2 being the distance between axes D1 and D2, and A1 the distance between axes D1 and D.

The reduction ratio of lever 75 on the plate side is equal to A4/A3, A4 being the distance between axes D3 and D4, and A3 the distance between axes D3 and D.

The traction force applied to wire 5 is approximately 0.5 N per side. Preferably, lever 75 on the plate side allows prestressing to be performed, and lever 85 on the bridge side allows fine adjustment (and frequency adjustment) to be performed.

In a specific embodiment, as illustrated by the Figures, the reduction ratios are different on the bridge side and on the plate side.

In a specific embodiment, in proximity to the two ends of torsion wire 5, the materials chosen for lever 85 on the bridge side, and for lever 75 on the plate side, have different thermal expansion coefficients.

Moreover, FIG. 8 shows another thermal compensation means, formed by inserting a small connecting rod 44 between, on the one hand, plate 7 or bridge 8 respectively, and on the other hand, the opposite adjustment lever 85, respectively 75, the expansion of this connecting rod 44 thus modifies the position of the lever 85 or 75 concerned, and consequently, corrects the pressure on the corresponding bush 11, 13, and the tension of wire 5. In the variant illustrated by the Figures, this connecting rod 44 is embedded in plate 7 in a counterbore 452. This connecting rod 44 is that on which end 453 of adjustment screw 45 of lever 85 bears. Lower surface 451 of the head of screw 45 is remote from a counterbore 8A of bridge 8, with play J. The choice of material of connecting rod 44 makes it possible to compensate for the thermal effect, the expansion of connecting rod 44 modifying the bearing position of end 453 and thus the position of adjustment lever 85 and abutment on clamp 11.

The invention permits the production of an independent equipped module 300, comprising torsion wire 5 carrying at least one balance 2 in the median portion, and anchoring means 301 and 302 at the two ends thereof. The first anchoring means 301 are used for embedding the end of a first useful strand 51 of torsion wire 5 and second anchoring means 302 are used for embedding the end of a second useful strand 52 of torsion wire 5, first useful strand 51 and second useful strand 52 being on both sides of at least one balance 2.

FIG. 8 also shows one part of a removable tool 401 for introducing such an equipped module 300. Bush 110 comprises a groove 111 with which a lip 87 of this tool 401 cooperates. Likewise, a lip 77 of tool 401 can cooperate with a groove 131 of bush 130 gripping clamp 13 of the second anchoring means 302. In a specific configuration illustrated by FIGS. 8 and 9, plate 7 and bridge 8 are each configured with a lateral opening to allow the lateral insertion of such an equipped module, bushes 110 and 130 being carried over a semi-cylinder in this specific variant. Beaks 87 and 77 act as a fork to permit insertion and positioning, it is then sufficient to adjust the tension via adjustment levers 85 and 75, and to perform angular indexing via strips 83 and 73.

Figure 9:
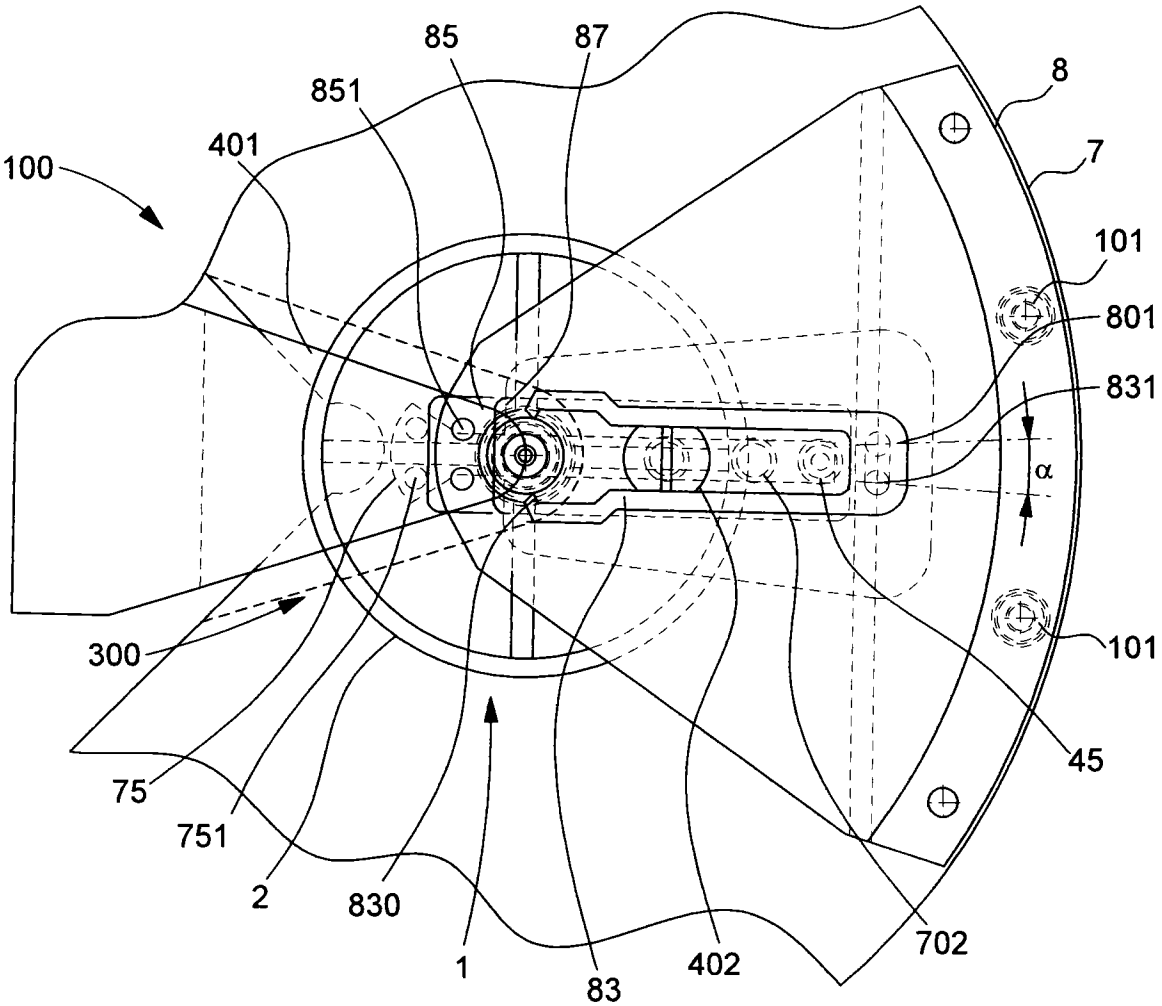
FIG. 9 shows a top view of the mechanism of FIG. 8, in a specific embodiment comprising means of angular adjustment to the guide-mark; this regulating member is shown with the same tool for introducing the same equipped module, and with another removable tool formed by a temporary holding screw for the initial assembly.
Figure 10:
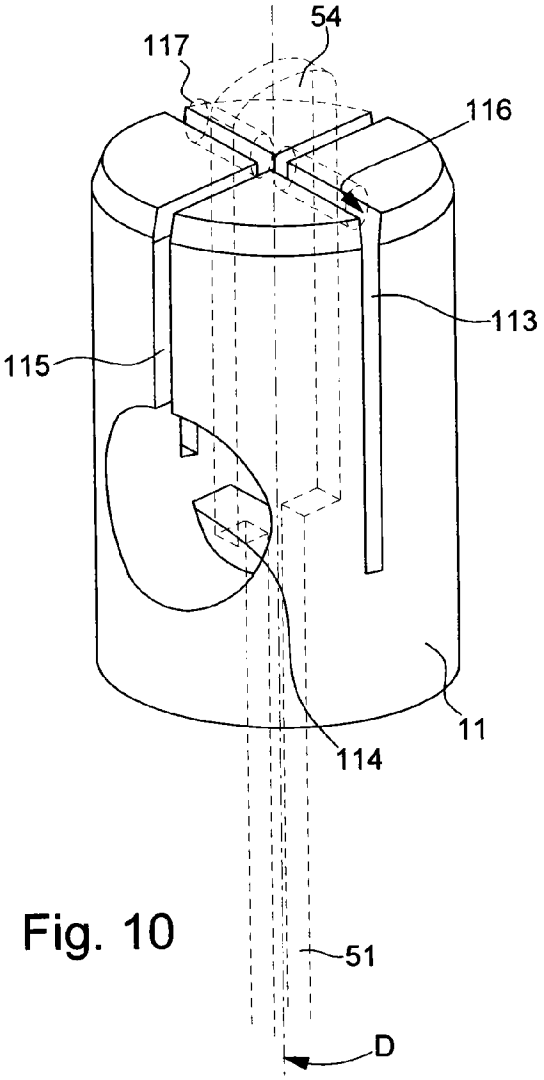
FIG. 10 shows a schematic perspective view of a central portion of the torsion wire anchoring means, formed by a clamp, showing, in a dotted line, an end plate comprised in a torsion wire according to FIG. 5 inserted in a first slot parallel to the axis, and a pin passing through a bore in the end plate and mounted bearing on a V at the opening of a second slot parallel to the axis and orthogonal to the first slot.

FIG. 9 shows another removable tool 402 formed by two screws for temporary holding in the theoretical angular position for the initial assembly. Each screw enables beaks 830, 730 to be moved away from the strip 83, 73 concerned during insertion of the module, the disassembly of each screw releases the corresponding beaks and permits angular indexing.

FIG. 9 also illustrates, more specifically, a variant with angular indexing to the guide-mark. Arm 83 is held by screw 801, not in a bore, but a hole 831 and screw 801 limits the angular motion of strip 83 at angle $\alpha$. This permits fine adjustment of the alignment of the guide-marks of the impulse pin, fork and escapement line.

In an advantageous embodiment shown in FIG. 8, regulating member 1 comprises at least one component, here a small connecting rod 44, embedded in a housing 452 of plate 7 and which lengthens at the same time as torsion return means 4, particularly torsion wire 5.

The invention also concerns a timepiece 200 including at least one such timepiece movement 100. Preferably, this timepiece 200 is a watch. More specifically this watch 200 is provided with a regulating member 1, which oscillates at a frequency higher than or equal to 5 Hz and makes the best use of the advantages of regulating member 1 with torsion wire 5 according to the invention.

In short, the use of a suitable torsion wire offers the advantage of fulfilling a dual function:

generating the return torque of the balance, replacing the conventional balance spring;

suspending the balance, while removing the requirement for pivots.

The torsion pendulum has, in theory, perfect isochronism, and the solution implemented by the invention provides a satisfactory answer to obtain regularity of working of the watch in every position.

The invention claimed is:

1. A watch regulating member, comprising:

at least one balance wheel oscillating about an axis of oscillation and subjected to a return torque exerted by torsion return mechanism, wherein at least one balance includes an attachment structure causing said balance to oscillate integrally with at least one torsion wire which forms said torsion return mechanism specific to said at least one balance, and wherein a largest dimension of the cross-section of a useful portion of said torsion wire which is subjected to torsion is less than 100 micrometers, a smallest dimension of the cross-section of said useful portion is less than 50 micrometers, a total length of said torsion wire is less than 6 millimeters, and further comprising a mechanism to tension said at least one torsion wire, and wherein said balance comprises, on both sides of said attachment structure along said axis of oscillation, first and second structures to limit radial clearance between said torsion wire and said balance.

2. A regulating member according to claim 1, wherein said torsion wire has a modulus of elasticity greater than 100 GPa, and an elastic limit greater than 2000 MPa.

3. A regulating member according to claim 2, wherein the torsion wire is made of metallic glass, or an at least partially amorphous alloy comprising by mass 75.44% of nickel, 13% chromium, 4.2% iron, 4.5% silicon, 0.06% carbon, and 2.8% boron.

4. A regulating member according to claim 1, wherein said torsion wire is of rectangular or square cross-section.

5. A regulating member according to claim 1, wherein, to avoid any detrimental bending mode, said torsion wire comprises at least one intermediate plate of greater cross-section than the useful strands of said torsion wire working in torsion, said intermediate plate being fixed to said at least one balance.

6. A regulating member according to claim 1, wherein, for operation by said mechanism to tension, said torsion wire comprises at at least one end thereof at least one intermediate plate of greater cross-section than useful strands of said torsion wire working in torsion.

7. A regulating member according to claim 6, wherein said mechanism to tension comprises an anchoring structure, which is arranged to embed said at least one torsion wire, and which includes, at a first end of said torsion wire, a first anchoring structure, and/or, at a second end of said torsion wire opposite the first end, a second anchoring structure, and wherein said first or second anchoring structure comprises a clamp configured to receive and clamp said end plate under action of a bush concentric to said clamp.

8. A regulating member according to claim 7, further comprising a tension adjustment mechanism configured to act on said mechanism to tension to adjust the tension of said torsion wire, and wherein said tension adjustment mechanism is arranged to exert a force on said clamp to adjust the position thereof.

9. A regulating member according to claim 8, wherein said tension adjustment mechanism comprises at least one adjustment lever configured to act in abutment on said bush to modify a position thereof, said adjustment lever comprising at least one area of reduced cross-section conferring sufficient elasticity on said adjustment lever.

10. A regulating member according to claim 9, further comprising a thermal compensation mechanism, formed by insertion of a small connecting rod between a plate or respectively a bridge, between said plate and bridge there is stretched said torsion wire, and said opposite adjustment lever, expansion of said rod modifying a position of said adjustment lever concerned, and, consequently, correcting pressure on said bush and the tension of said torsion wire.

11. A regulating member according to claim 10, further comprising, at each of said two ends of said torsion wire, said adjustment lever, which have reduction ratios that are different, to achieve thermal compensation allowing for automatic adjustment of the tension of said torsion wire according to temperature.

12. A regulating member according to claim 9, further comprising, at each of said two ends of said torsion wire, said adjustment lever, which have reduction ratios that are different, to achieve thermal compensation allowing for automatic adjustment of the tension of said torsion wire according to temperature.

13. A regulating member according to claim 1, forming an independent equipped module, comprising said torsion wire carrying said at least one balance in a median part thereof and a first anchoring structure and a second anchoring structure at the two ends thereof, said first anchoring structure being used to embed an end of a first useful strand of said torsion wire, and said second anchoring structure being used to embed an end of a second useful strand of said torsion wire, said first useful strand and said second useful strand being on both sides of said at least one balance.

14. A regulating member according to claim 1, wherein said mechanism to tension includes an anchoring structure, which is arranged to embed said at least one torsion wire, and which includes, at a first end of said torsion wire, a first anchoring structure, and/or at a second end of said torsion wire opposite the first end, a second anchoring structure.

15. A regulating member according to claim 1, further comprising a tension adjustment mechanism arranged to act on said mechanism to tension to adjust the tension of said torsion wire.

16. A regulating member according to claim 1, wherein said torsion wire is made of an at least partially amorphous alloy formed solely of zirconium, titanium, copper, nickel and beryllium, and comprising between 41 and 44% by mass of zirconium, between 11 and 14% by mass of titanium, between 9 and 13% by mass of copper, between 10 and 11% by mass of nickel, and between 22 and 25% by mass of beryllium.

17. A regulating member according to claim 16, wherein said torsion wire is made of Liquidmetal® metallic glass referenced LM1b.

18. A regulating member according to claim 1, wherein the torsion wire is made of metallic glass, or an at least partially amorphous alloy comprising by mass 75.44% of nickel, 13% chromium, 4.2% iron, 4.5% silicon, 0.06% carbon, and 2.8% boron.

19. A regulating member according to claim 18, wherein said torsion wire is made of Metglas® metallic glass referenced MBF20.

20. A timepiece movement comprising at least one said regulating member according to claim 1, oscillating between a plate and a bridge, wherein, to embed said torsion wire, the movement includes an anchoring structure to anchor said regulating member, formed by a first anchoring structure to anchor to said bridge and by a second anchoring structure to anchor to said plate, and which together define said axis of oscillation of said regulating member.

21. A timepiece comprising at least one timepiece movement according to claim 20, wherein the timepiece is a watch, and wherein said regulating member oscillates at a frequency higher than or equal to 5 Hz.

22. A timepiece movement according to claim 20, wherein the movement includes a tension adjustment mechanism for said torsion wire through adjustment of a distance between said bridge and said plate.

23. A timepiece movement according to claim 22, wherein said tension adjustment mechanism includes a threaded bush which cooperates in a complementary manner with an internal thread of said plate, and at least one screw cooperating with a nut integral with said plate is arranged to push said bridge towards said plate, in abutment on said bush in the adjustment position thereof.

* * * * *